United States Patent [19]

Lengyel

[11] 4,138,872

[45] Feb. 13, 1979

[54] METHOD AND APPARATUS FOR EXTRUSION

[75] Inventor: Bela Lengyel, Twickenham, England

[73] Assignee: National Research Development Corporation, London, England

[21] Appl. No.: 756,796

[22] Filed: Jan. 4, 1977

[30] Foreign Application Priority Data

Jan. 6, 1976 [GB] United Kingdom ..... 00262/76
Sep. 17, 1976 [GB] United Kingdom ..... 38615/76

[51] Int. Cl.[2] ..... B21C 23/04; B21C 25/06

[52] U.S. Cl. ..... 72/262; 72/422; 198/626; 226/172

[58] Field of Search ..... 72/262, 422, 60, DIG. 31; 198/626; 226/172, 173

[56] References Cited

U.S. PATENT DOCUMENTS

| | | | |
|---|---|---|---|
| Re. 28,795 | 5/1976 | Fuchs, Jr. | 226/172 |
| 2,046,997 | 7/1936 | Boddy et al. | 226/172 |
| 3,922,898 | 12/1975 | Voorhes | 72/262 |
| 3,934,446 | 1/1976 | Avitzur | 72/262 |
| 3,985,011 | 10/1976 | Fuchs, Jr. | 72/262 |
| 4,027,514 | 6/1977 | Moreau | 72/60 |
| 4,051,705 | 10/1977 | Andrus et al. | 72/60 |

*Primary Examiner*—C.W. Lanham
*Assistant Examiner*—Daniel C. Crane
*Attorney, Agent, or Firm*—Oblon, Fisher, Spivak, McClelland & Maier

[57] ABSTRACT

Method and apparatus for forming material by passing it through a container, in which the material receives the force required to form it by contact with driven, recirculating members which make up the inner wall of the container and define the passage available for the material. This passage may be of constant cross-section, or may diverge. The invention includes both the extrusion of solid billet through a die held at the container outlet and the compaction of powder into a coherent solid.

23 Claims, 22 Drawing Figures

METHOD AND APPARATUS FOR EXTRUSION

BACKGROUND OF THE INVENTION

Field of the Invention

This invention relates to apparatus and methods for forming material, including the forming of powder into solid products. It relates in particular to extrusion and especially to the continuous (i.e. uninterrupted) extrusion of materials from long billets into products of variable length.

SUMMARY OF THE INVENTION

Apparatus and methods according to the invention are as stated in the claims set out at the end of this specification. The invention also contemplates an apparatus comprising an elongated hollow container open at one end and adapted to support a die at the other, and means to force a billet into the open end of the container so that it is extruded through a die when held at the other end. The container is faced with at least one set of passage-forming members adapted to bear against the sides of the billet, so that the billet is encased within a tube made up of such members as it passes through the container, the members being adapted to travel with the billet through the container. Also provided are means to re-cycle sets of members back to the beginning of the tube after reaching the end. There may be more than one set of members, successive sets of members being disposed along the length of the container, so that the "tube" comprises a stack of at least two sets of members.

The apparatus may be for the hot extrusion of billets and may include heating means through which the passage-forming members may pass during re-cycling.

The container of which the tube of passage-forming members is a part may also include a hollow outer tube or like device, against which the members slide as they move with the billet, the necessary radial force upon the billet through the members being supplied by their reaction with the outer tube.

Alternatively the container may include a plurality of rams or like devices adapted to bear upon the passage-forming members in directions angled towards the axis of extrusion, and the movement of the members through the container may cause them to pass into and out of contact with successive rams as the movement proceeds.

At least the greater part of the extruding force may be imparted to the passage-forming members, and may be transmitted by them to the billet. This extruding force may be applied to the members by rams or the like bearing upon the set of members at the begining of the tube, and if there is more than one set of members this force may be transmitted to succeeding sets by contact between them. There may be interlocking engagement between the members of any one set, whereby some of these members are capable of transmitting axial thrust upon the others, and the axial force from the rams may then be applied only to those members of the sets that are capable of transmitting thrust to the other in that way. Successive sets of members within the stack may be so arranged that those members that are to receive thrust from the rams or the like occupy different positions around the billet from those in the preceding or succeeding set, whereby rams to apply thrust to one set do not have to be disconnected, thus halting the drive to the billet, while the succeeding set is put into place and its rams connected. There may be alternative positions for the transmitting members of each set, and two corresponding sets of driving rams to be applied alternately as one such set succeeds another.

There may be means to bring a re-cycled set of passge-forming members into contact with the billet upstream of the container proper, to effect some preliminary deformation of the billet and preliminary alignment of the members before they enter the guiding system of the container.

The cross-section of the tube of passage-forming members may be substantially constant from the open end of the container until close to the other end, where of course, it decreases to the relatively small-cross section of the die when it is in place. In this case friction will be mainly responsible for transmitting the drive from the passage-forming members to the billet. Alternatively, and preferably, the cross-section of the tube may be gently divergent from the open end of the container until close to the other end, at least some of the passage-forming members being constrained to move, and with them the outer surface of the billet, along diverging paths. The divergence may apply to one or both axes of the cross-section, which may be of many shapes, for instance square, rectangular, triangular, L-shaped, or profiled. In one particular case where the initial section is square or rectangular, one dimension of the square or rectangule may remain unchanged throughout while the other may expand slightly to give the divergence. Where there are diverging members, their wedge action against the billet will be responsible for transmitting much of the drive to it.

While the extrusions to which this invention applies often take place while heated and without lubrication, it is sometimes preferable according to the present invention, especially but not only when the cross-section of the inner tube is constant, to make the inner walls of that tube notably rough and thus raise the coefficient of friction between the passage-forming members and the billet.

Apparatus according to the invention may also be used to form solid products from powder. In such an operation the powder will first compact within the inner tube, after which the passage-forming members may bear upon the compacted mass to expel it from the container. Compacting may be effected with the aid of a compacting ram, or may possibly take place under gravity alone in some cases when the container axis lies vertical.

The invention also includes processes of forming material, using the apparatus as just described, and the products of such formation.

BRIEF DESCRIPTION OF THE INVENTION

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
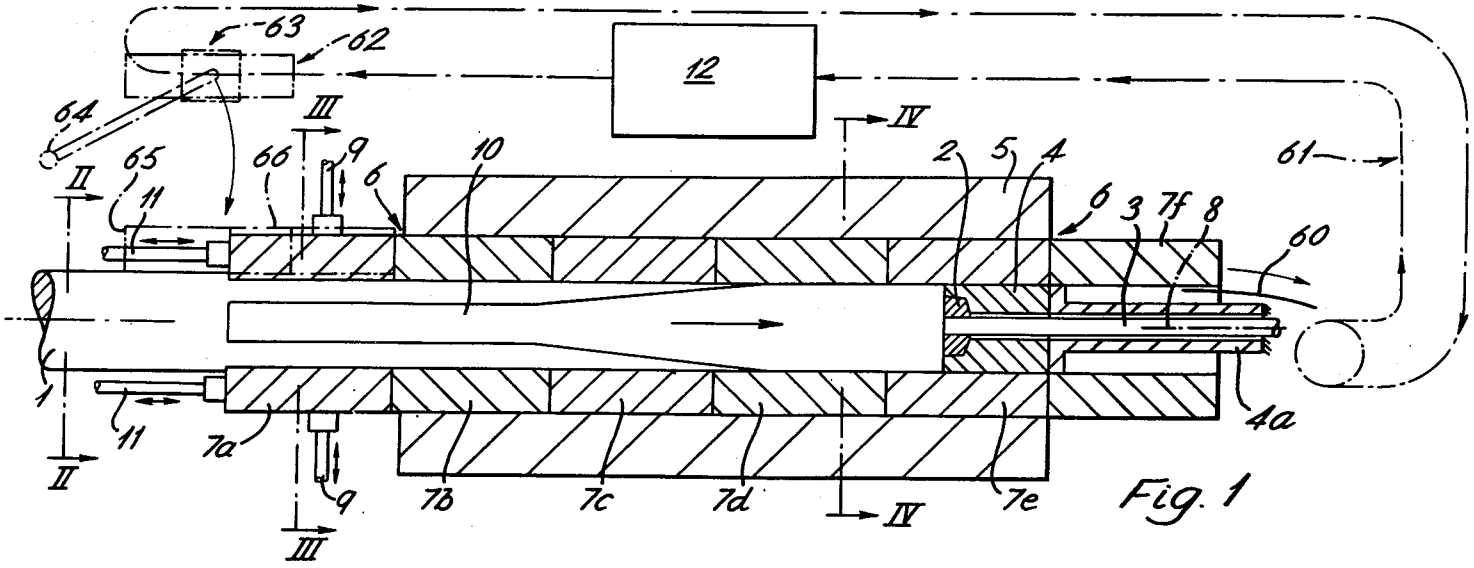
FIG. 1 shows one form of apparatus in outline, and in axial cross-section.
Figure 4:
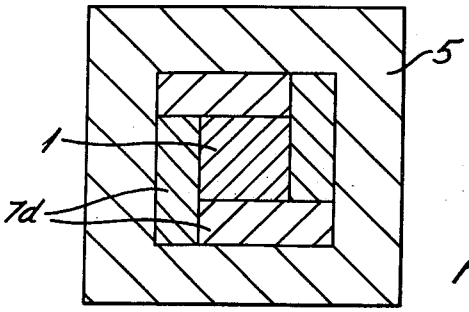
FIG. 4 is a section on the line IV—IV in FIG. 1.
Figure 3:
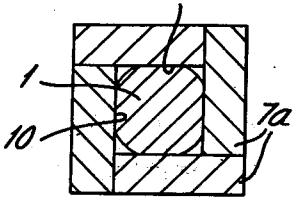
FIG. 3 is a section on the line III—III in FIG. 1.
Figure 2:
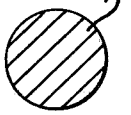
FIG. 2 is a section on the line II—II in FIG. 1.

The purpose of the apparatus outlined in FIG. 1 is to extrude an elongated billet 1 through a die 2 to form an extruded product 3. Die 2 is held by structure 4, supported by an anchored member 4*a* and forming in effect a wall at one end of a hollow container comprising an outer support structure 5, defining a square-sectioned cavity 6. Within cavity 6 is formed an inner passage, comprising a stack of passage-forming members 7, which together make up the inward surface of the container. The members are arranged in sets of four, all the members of one set lying in the same transverse plane relative to the axis of the container, that is to say the extrusion axis 8. The four members of the first (i.e. most leftward) set of members 7 are referenced 7*a* in FIGS. 1 and 3, the plane of FIG. 4 crosses through the fourth set of which the members are referenced 7*d*, and the members of the final (i.e. most rightward) set shown in FIG. 1 are referenced 7*f*. As the raw billet approaches the left-hand end of structure 5 and reaches the plane of section of FIG. 3, members 7*a* are assembled around it and pressed against it by rams indicated at 9, so that flats 10 are formed upon the initially round outline of the billet and the assembled members 7*a* are formed into a square pack so that they may enter cavity 6. Rams 11 are brought to bear against the rear end faces of members 7*a*, bringing the forward end faces of members 7*a* to bear against the rear end faces of the members 7*b* of the next set, which is already within the cavity, then forcing all four members of the set into the cavity, driving the members of preceding sets b to f before them. The billet also is drawn forward into the container by the frictional grip of the stack upon it. When the forward end of the billet first reaches the die, an end load develops upon it. Fricational drag provided between the members 7 and the billet is sufficiently large and the end load increases to a level at which the billet tends to expand in cross-section so as to fill the cross-section of the stack, as shown in FIG. 4. As the load and axial stress on the end of the billet increases, so does the radial stress, i.e. the pressure, upon the wall of the stack, and as the plastic deformation of the billet extends away from the die, the interfacial area between the billet and the stack increases also. Both the rise in radial pressure and the greater interfacial area increase the frictional drag upon the billet, which in turn further increases the billet/die pressure, until this reaches the level at which extrusion begins. This equilibrium condition is then maintained as long as the parameters of the process remain the same, so that a steady-state continuous extrusion process is established.

In FIG. 1 members 7*e* are seen about to escape from the container by passing through the clearance between wall 4 and structure 5, and members 7*f* have just escaped. After rams 11 have pushed the entire stack and billet forward so that members 7*a* have come to occupy the position in which members 7*b* are shown in FIG. 1, rams 9 will have been retracted and rams 11 may be retracted also by about the length of one member set and the four members 7*f* will be removed from the stack and re-cycled.

FIG. 1 shows diagrammatically a system by which one of the members 7*f* could be re-cycled; three more such systems would be needed for the other three members of the set. The system comprises a chute 60 which receives the member from the outlet end of the stack and allows it to fall on to a continuous conveyor 61. This carries the member through a reheating furnace 12 to a take-off point 62 where tongs 63 pivoted at 64 lift it off the conveyor, then rotate about 64 and place the member in contact with billet 1 in the position indicated at 65. Ram 11 will now be reapplied to drive the member into position 66 and to resume the drive to one flank of the stack of members 7. In position 66, it will be seen, the member does not indent the billet. Ram 9 will then be reapplied to bring the recycled member from position 66 into the 7*a* position.

Figure 5A:
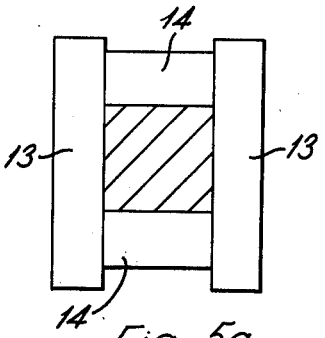
FIG. 5 shows five diagrammatic end views (a to e) of passage-forming members and billets, showing the billets in cross-section.
Figure 5B:
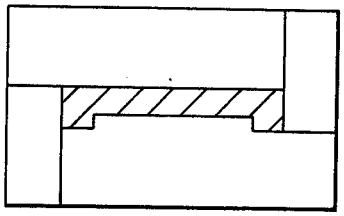
Figure 5C:
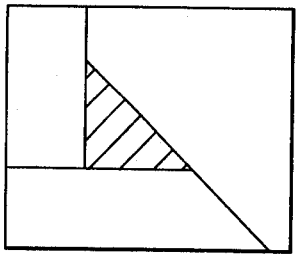
Figure 5D:
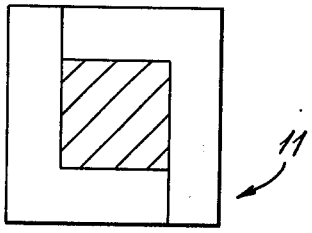
Figure 5E:
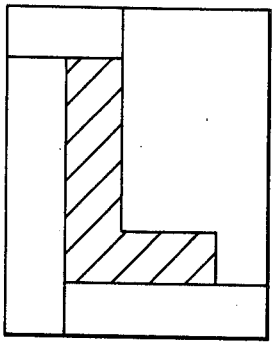

FIGS. 1 to 4 show the billet 1 encased within a stack of members, all four members in each set of that stack being identical. FIG. 5 shows some alternative arrangements in which the members of each set are not identical. Thus FIG. 5*a* shows a square billet surrounded by a set comprising two long members 13 and two short members 14, FIG. 5*b* shows a profiled strip of shallow channel-section surrounded by a set of four members of three different kinds, FIG. 5*c* shows triangular-section strip surrounded by a set of three different members, FIG. 5*d* shows square strip enclosed by a set of two different members each of L-shape, and FIG. 5*e* shows "L"-section strip enclosed within a set of four members, all having different resulting configurations.

Figure 9:
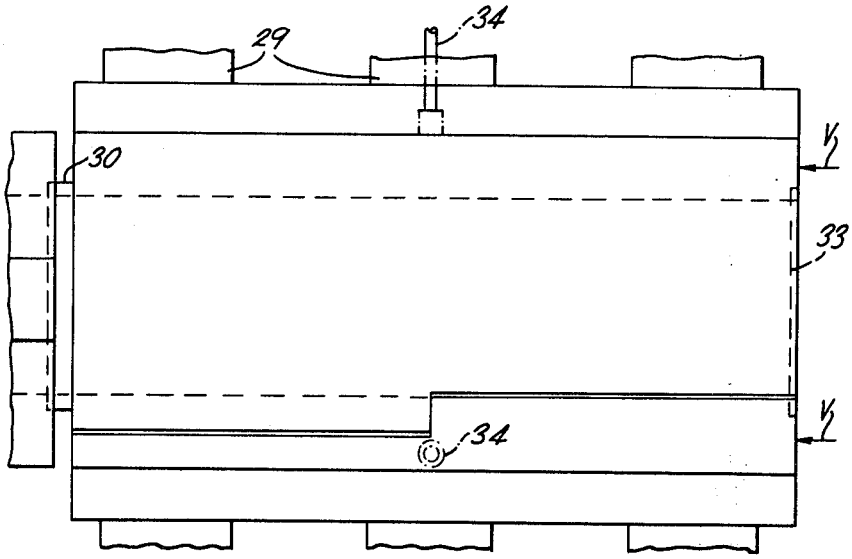
FIG. 9 is a side view, in greater detail, of some parts of the apparatus shown in FIG. 1 and lying close to the line IV—IV.
Figure 10:
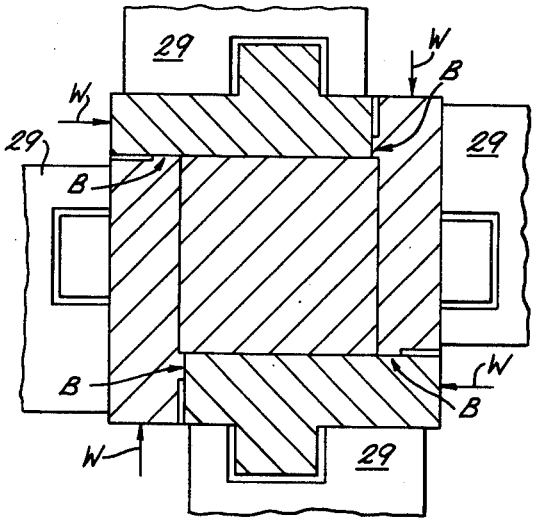
FIG. 10 is a section through the apparatus shown in FIG. 9, taken on the line X—X.

FIGS. 6 to 10 illustrate in more detail one possible method as to how members 7 can be applied the head of a new billet to for initial flattening and compression, and how it can then be ensured that these members and other parts remain correctly aligned. FIGS. 9 and 10 in particular illustrate one possible way in which any tendency for the billet material to flow between the members 7 may be opposed once the members and billet completely fill the cross-sectional area of the cavity 6, as they do in FIG. 4.

Figure 6:
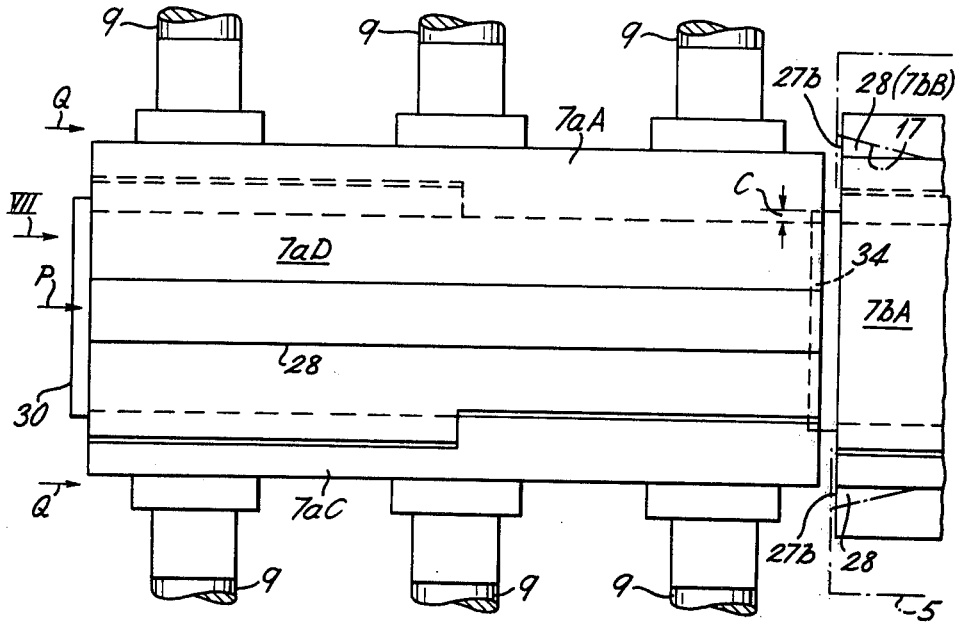
FIG. 6 is a side view, in greater detail, of some parts of the apparatus shown in FIG. 1 and lying close to the line III—III.

FIG. 6 shows members 7 in position (a) of FIG. 1, and parts of other members 7 in position (b). It also gives an outline of the outer structure 5, the mouth 17 of which is chamfered to ease the entry of the members once they have been aligned in position (a).

Figure 7:
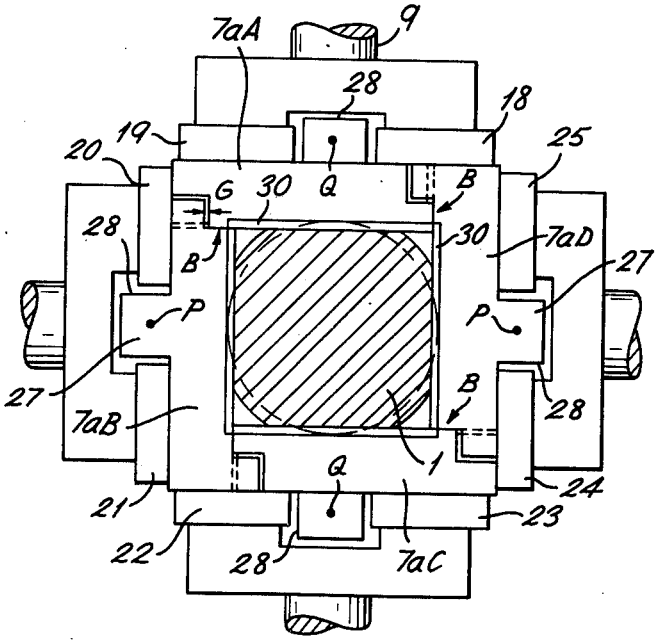
FIG. 7 is an end view taken in the direction of the arrow VII in FIG. 6 with the billet shown in section.
Figure 8:
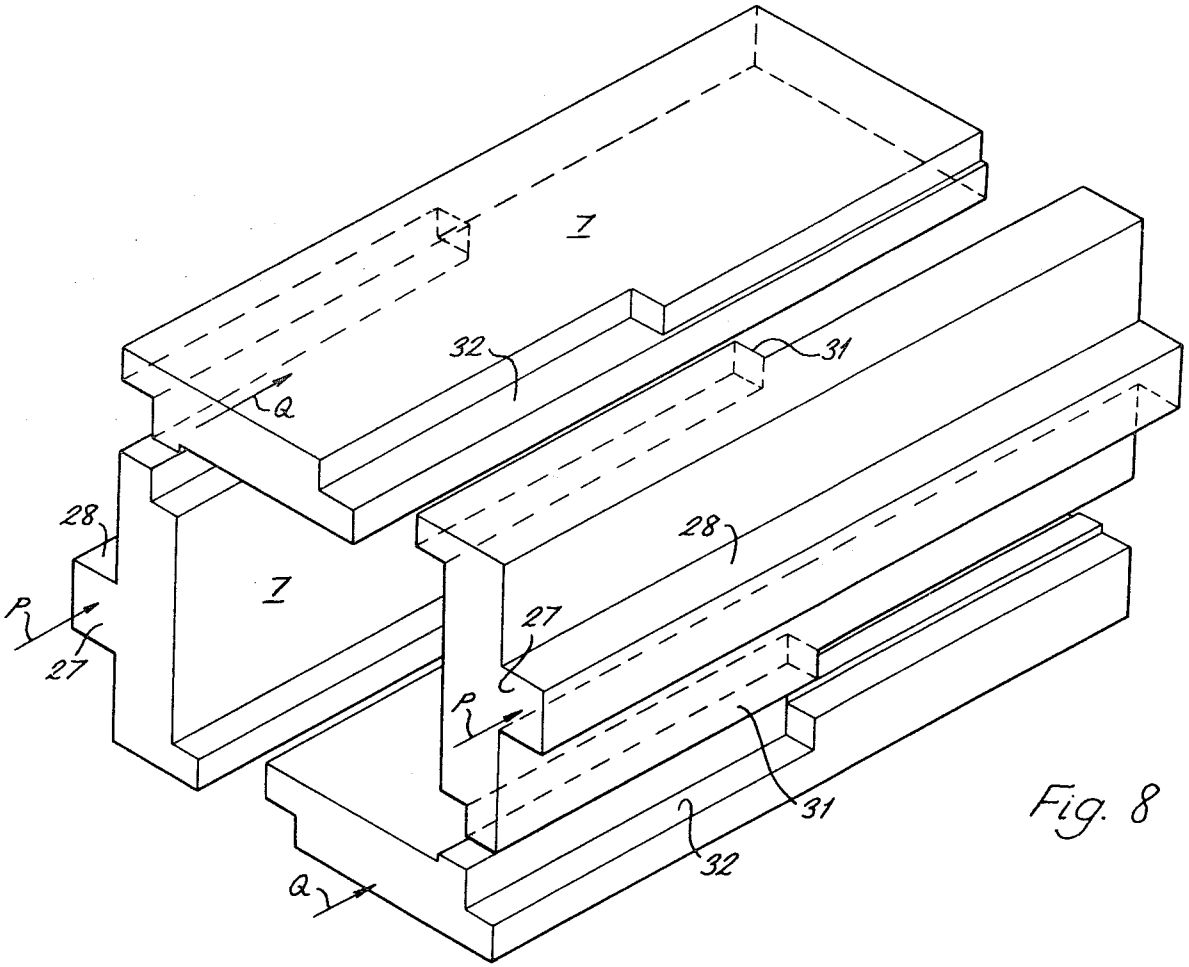
FIG. 8 is a perspective and exploded view of one set of passage-forming members as shown in FIG. 7.

In FIG. 7 the hatched section indicates the outline of the billet in position (a), after flattening. It is clear that the billet material does not at this stage reach the junctions of members 7aA, 7aB, 7aC and 7aD, so that members 7aA, and 7aB, 7aB and 7aC, 7aC and 7aD and 7aD and 7aA could, but need not be, in direct contact with each other over bearing areas B.

With the head of a new billet in position (a) the hydraulic rams 9 apply radial force to the billet 1 through pressure pads 18 to 25. Initially the rams and pads are withdrawn, but only slightly because the required movement of these rams and pads is small, since the difference between the undeformed and deformed billet sizes is small also. The head of the billet, the original circular outline of which is represented by the dashed line 26 in FIG. 7, is then fed forward. Then members 7aA and 7aC, and 7aD and 7aB are placed in position between the pads 18–25 and the billet. The shape of these members is shown in isometric projection in FIG. 8. The undeformed billet and the pressure pads ensure sufficient alignment of members 7a, as FIGS. 6 and 7 show. Now radial forces are applied by rams 9 and the billet is flattened on four sides. It has already been mentioned that parts 7a need not come into full contact over bearing areas B, so that the radial forces of rams 9 are applied to the billet material only, and can be maintained constant ensuring a constant pressure and thus providing controlled frictional force at the interfaces of the billet and members 7a.

Now axial forces P are applied (through rams 11, not shown in FIGS. 6 and 7) to the end faces 27 of ribs 28 on members 7aB and 7aD. Owing to the interlocking of flanges 31 and recesses 32 illustrated in FIGS. 7 and 8, these forces (P) will force parts 7aA and 7aC axially forward. Once the set of members 7a reaches position (b) of FIG. 1 rams 9 and pressure pads 18–25 are withdrawn, a set of members is re-cycled as already described and the sequence is repeated with the re-cycled members. However, the positions of parts A to D change for alternate sets of members, so that parts A and D of one set are in the positions shown in FIG. 7 and for the next set they are displaced by 90° as indicated for the members B, A and D of the 7b set shown within the outer structure 5 at the right hand end of FIG. 6. FIG. 7 also shows the end faces 27b of the ribs 28 on members 7bB and 7bD. Then the axial driving force is applied in positions Q by another pair of rams 11. In this manner the rams which apply forces Q can be withdrawn while forces P still drive the stack of members 7 forward and vice versa so that, although the application of forces P and Q is cyclic, the forward movement of the stack is continuous. Of course continuous operation cannot be achieved in the extreme case within the invention in which the "stack" comprises a single set of members, when extrusion must cease as they are re-cycled.

FIG. 1 shows the outline of flat 10 and thus the shape of the billet once the steady state extrusion condition has been established. From the position of the set of members 7c onwards towards the end wall structure 4 and the die 2, the pressure of the billet against the stack of members 7 increases so that it is no longer essential to maintain radial pressure between stack and billet by external means such as rams 9. This pressure will be present so long as the members 7 (e.g. those of set d shown in FIGS. 9 and 10) are restrained from moving radially outward, for instance by the rigid outer structure 5 of FIG. 1 or by the stationary rigid pressure pads 29 of FIGS. 9 and 10.

As the billet approaches the die and the interfacial pressure between the billet and the stack of members 7 rises, billet material will tend to escape between adjacent stack members unless the interfacial pressure between such members exceeds that between the billet and the stack. To help ensure this excess the bearing areas B between adjacent members 7 of any one set are deliberately restricted to less than the full projection of one such member upon another, and the engagement of a member of one set with the corresponding member of the next is similarly restricted by forming a narrow spigot or ridge 30 on one such member and a corresponding but less deep socket or channel 31 on the other. To improve the force of engagement between spigots 30 and sockets 33 still further the stack may be subjected to forces in the opposite direction to that of the extrusion (V, FIG. 9). These forces, like those of the rams 11, must act along alternate lines against successive sets of members of the stack if extrusion is to be continuous. To ensure the necessary level of pressure between adjacent members 7 of the same set tangential forces W (FIG. 10) may be provided, for instance by rams 34 (shown in outline in FIG. 9); if the radial restraint is provided by a continuous outer structure such as 5, rather than the individual pads 29, then the structure must of course be cut away to allow access for such rams.

Figure 13:
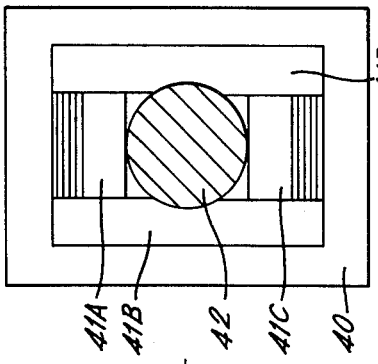
FIG. 13 is an end view in the direction of the arrow XIII in FIG. 11, with the billet shown in section.
Figure 11:
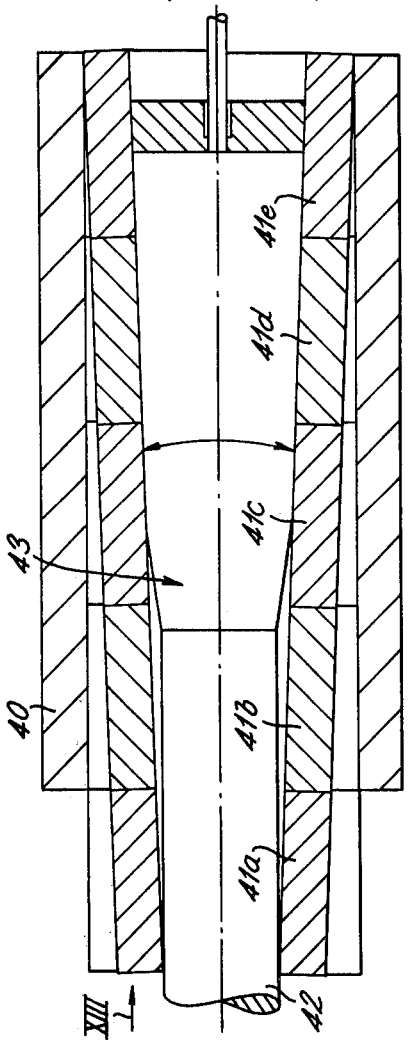
FIG. 11 shows another form of apparatus in outline, and in axial cross-section.
Figure 12:
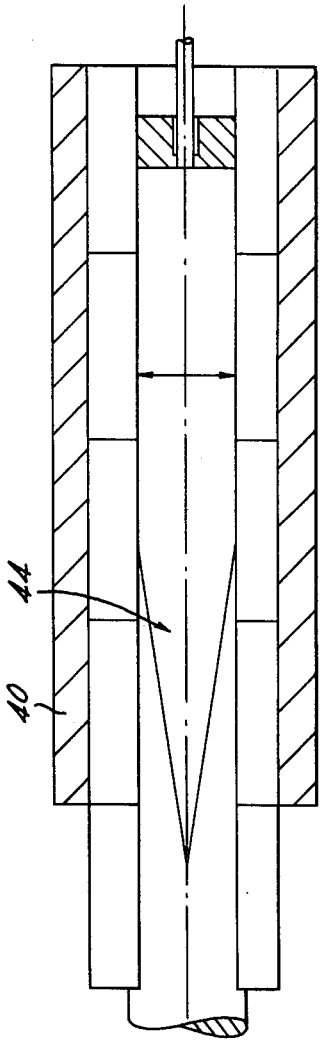
FIG. 12 is another axial cross-section of the apparatus shown in FIG. 11, but taken in a plane at right angles.

In the alternative constructions according to the invention and shown in FIGS. 11 to 15, the stack of passage-forming members is constrained to define a divergent passage for the billet. In FIGS. 11–13 an outer structure 40 contains passage-forming members 41 so that while those in the B and D positions (FIG. 13) travel along parallel paths, those in the A and C positions travel along diverging paths. The means chosen to position the members initially, to compact them around the billet 42 in the 41a position and then contain them radially and to drive them axially may be similar to those already described for stacks of constant cross-section. However, in selecting the size of gap G (FIG. 7) and the size of the parts corresponding to spigots 30, sockets 33 etc. which ensure that members A to D of each set travel as a single unit, allowance must be made for the relative movement of members A and C in respect of B and D. Contours that form upon the billet during steady-state extrusion are shown at 43, 44.

Figure 14:
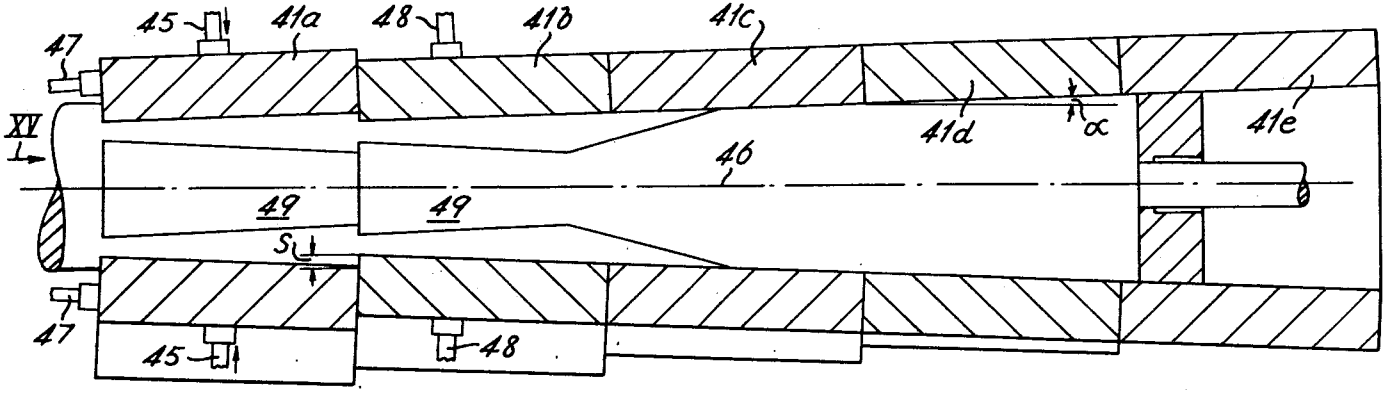
FIG. 14 is an outline axial cross-section through another apparatus with a divergent container.
Figure 15:
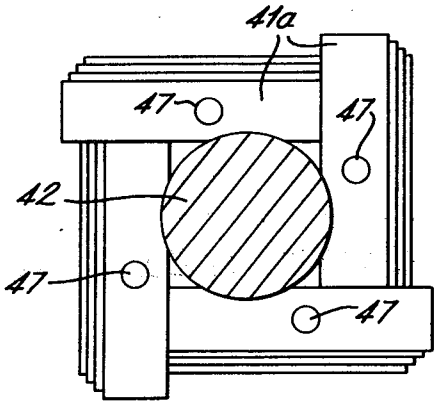
FIG. 15 is an end view in the direction of arrow XV in FIG. 14, with the billet shown in section.

An arrangement in which all four members A to D of each set of members 41 diverge is shown in FIGS. 14 and 15. In position (a) the billet 42 is flattened by members A to D of set 41a which are forced radially inwards by rams 45; throughout this operation the members lie at an angle $\alpha$ to the axis of extrusion 46. Still retaining this angle, the members of set 41a are now advanced axially towards the die by rams 47 until they occupy position b; as the members advance thus, further rams 48 to contain the stack radially must retract and re-advance cyclically to allow passage for the leading edges of the members. Flats 49 on the surface of the billet (FIG. 14) show that the billet material expands into the stack of members 41 and thus exerts pressure upon the wall of it in position (c). Up till them rams such as 45, 48 are used for the radial containment of the stack and the billet within it, but after that stage the members A to D each move towards the die along divergent paths inclined at an angle $\alpha$ to the extrusion axis, and an appropriately placed rigid restraint (such as pads 29, FIGS. 9 and 10) will suffice to hold the members radially. Again many details of the construction may correspond with those for earlier versions of the invention as shown in FIGS. 6–10, but for the versions of FIGS. 14 and 15 the equivalent of bearing C between the adjacent members of one set of the stack must be larger than step S in FIG. 14.

Figure 16:
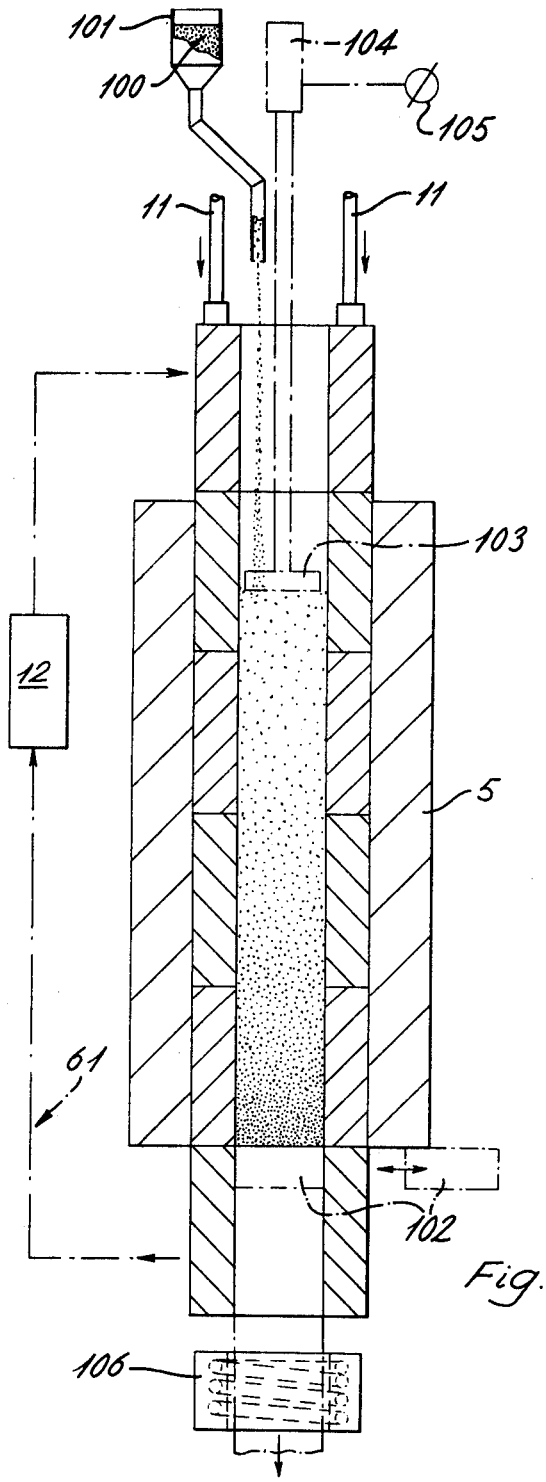
FIG. 16 shows yet another form of apparatus in outline, and in axial cross-section.

FIG. 16 shows apparatus according to the invention being used to compact metal powder, for instance copper, into a coherent rod-like solid product, capable of being converted by subsequent treatment into rod of useful strength. The apparatus is similar in many respects to that shown in FIG. 1 but axis 8 is now vertical, die 2 and structure 4 are absent, and powder 100 is fed into the mouth of the stack of members 7 from a hopper 101. Initially a closure member 102 may shut the outlet end of the stack so that powder accumulates within the stack and is compacted by gravity and the relative movement of the members 7. If desired, compacting can be aided by a ram 103 driven by a hydraulic cylinder 104 supplied from a pump 105. Once a solidified mass, with a firm lateral reaction against the members 7, has been created at the outlet end of the stack by this initial compacting member 102 may be removed and thereafter the apparatus will expel coherent rod continuously provided the speed of movement of members 7, the rate of powder feed and other parameters are correctly chosen. In such a process control of temperature, and hence the heating which the members 7 receive from the unit 12 as they recirculate, may be particularly important. The product emerging from the stack, although coherent, will usually be of low strength which may be improved by heat treatment, for instance by passing it through an induction furnace 106. A rod of acceptable strength may then be produced by feeding the resulting improved product as the input to extruding apparatus as shown in FIGS. 1, 11 or 14.

FIG. 16 shows the apparatus of FIG. 1 modified to compact powder, but the apparatus of FIGS. 11 or 14 could be similarly modified.

Figure 17:
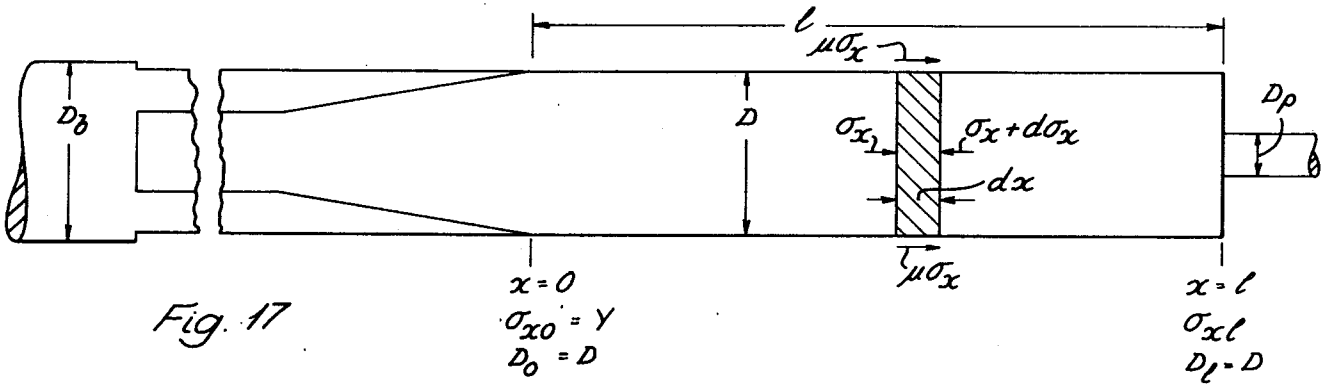
FIGS. 17 and 18 are schematic drawings showing some quantities to be used in an analysis of performance of two different apparatus according to the invention.
Figure 18:
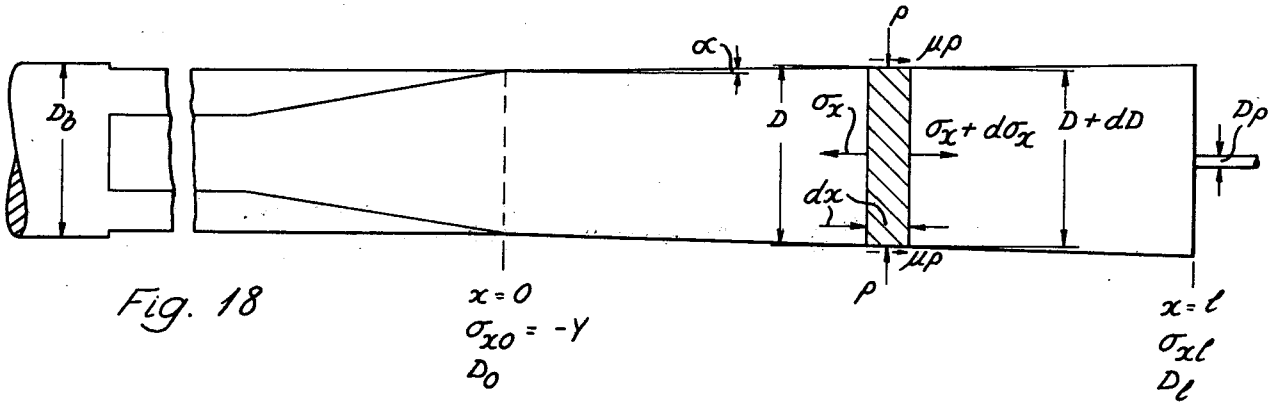

FIGS. 17 and 18 illustrate the dimensions and some other quantities relevant to the following analyses of the performance of parallel-section and divergent-section apparatus according to the invention. First let us assume the hot extrusion of an aluminium alloy in apparatus as shown in FIG. 17, under the following conditions:

Flow stress of the billet material $Y = 8$ tonf/in$^2$
Coefficient of friction $\mu = 0.1$
Square container $D = D_l = D_o = 4''$
Length of container $l = 16''$
Initial billet diameter $D_b = 4.25''$ For parallel container stack it may be shown that $$\frac{\sigma_{xp}}{y} = e^{\frac{4\mu p}{D}}$$

where $\sigma_{xl}$ is the flow stress of the material at section x = l

Thus $$\frac{\sigma_{xp}}{8} = e^{\frac{4 \times 0.1 \times 16}{4}} = 4.95 \qquad (1)$$

Therefore pressure at the die face due to frictional drag $$\sigma_{xl} = 39.62 \text{ tonf/in}^2$$

For a diverging container stack as shown in FIG. 18, $D_o = 4''$ at $x = 0$. A semi-angle $\alpha = 1°$ gives, at the die, $Dl = 4.56''$ for a stack of length $l = 16''$.

For the same material and friction coefficient as before $B = \mu\cot\alpha = 0.1 \cot 1° = 5.73$ It may be shown that $$\frac{\sigma_{xp}}{y} = \frac{1+B}{B}\left[1 - \left(\frac{D_p}{D_o}\right)^{2B}\right] - \left(\frac{D_p}{D_o}\right)^{2B};$$

therefore $$\frac{\sigma_{xp}}{8} = \frac{1+5.73}{5.73}\left[1 - \left(\frac{4.56}{4}\right)^{11.46}\right] - \left(\frac{4.56}{4}\right)^{11.46} = -9.37 \qquad (2)$$

Therefore $\sigma_{xl} = -74.96$ tonf/in$^2$.

From this example it is clear that the pressure at the die would increase considerably for the diverging container stack; under the assumed conditions it would almost double.

The difference is even more striking if the extrusion ratios are considered for the generated pressures.

Neglecting die friction, extrusion pressure q may be expressed as $$q/Y = 0.8 + 1.5 \ln R \qquad 3$$

where R is the extrusion ratio.

Using the present notation $$q = \sigma_{xl}$$

For a parallel container from equation 1

$$q/Y = (\sigma_{xl}/Y) = 4.95 = 0.8 + 1.5 \ln R_l \qquad 4$$

where $R_l = (D/D_p)^2$ and $D_p$ is the product diameter.

From equation 4, $R_l = 15.91$ which represents a rod of $D_p = 1.1''$ diameter.

The total extrusion ratio then, related to the original billet diameter of $D_b = 4.25''$ $$R_t = (4.25^2/1.1^2) = 14.9$$

For a diverging container from equation 2

$$q/Y = -\sigma_{xl}/Y = 9.37 = 0.8 + 1.5 \ln R_l$$

and with $R_l = (D_l/D_p)^2$ $R_l = 302.9$ equivalent to a rod diameter of $D_p = 0.26''$.

The total extrusion ratio relative to the original billet diameter becomes $$R_t = (4.25^2/0.26^2) = 267.2$$

In hot extrusion very often lubricants are not used. In such cases, as has already been stated, it could be advantageous to increase friction along the container stack by making its wall rough.

To evaluate the frictional drag under such conditions, assume that the frictional shear stress at the billet/container interface reaches the yield shear stress k of the billet material, a condition well known in metal working and called extrusion from a perfectly rough container. It means that, before relative displacement between container and billet could occur, pieces of the billet material are sheared off at the billet/container interface and remain stuck to the container. This is the reason for the alternative term of sticking friction.

Referring to FIG. 17 the frictional shear stress will now be k instead of $\mu\sigma_x$.

Making certain reasonable assumptions it may be shown that now:

$$\sigma_{xp} = Y\left(1 + \frac{2\rho}{D}\right)$$

Substituting the values of the previous example with $D = 4''$, $l = 16''$, $Y = 8$ tonf/in$^2$ $$\sigma_{xp} = 8(1 + \frac{2 \times 16}{4}) = 72 \text{ tonf/in}^2$$

To compute the extrusion ratio take equation 4 with $q = \sigma_{xl}$ $$q/Y = \sigma_{xl}/Y = 9 = 0.8 + 1.5\ ln.R_l$$

giving $R_l = 236.7$ which represents a rod diameter of $D_p = 0.29''$.

The total extrusion ratio relative to the initial billet diameter becomes $$R_t = (4.25^2/0.29^2) = 214.8$$

Comparing this figure with those obtained for lubricated extrusion it becomes clear that, in lubricated extrusion with a parallel container stack, under the assumed conditions an extrusion ratio of 14.9 could be obtained. This figure can be very substantially improved in two ways, first by making the parallel container with a rough internal surface, when an extrusion ratio of 214.8 can be achieved. Alternatively, in lubricated extrusion a divergent container stack could be used, to increase the feasible extrusion ratio to 267.2.

It should be emphasized that the divergent container assumed in these examples needs to have a semi-angle of only 1° for this vast increase of efficiency to be achieved, representing an increased bore dimension of only 0.56" over a length of 16". This is an important consideration in the design of a diverging container stack.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Apparatus for forming material comprising:

an elongated hollow container having an inlet end and an outlet end;

means for exerting a forming force upon said material to urge said material through the container and to expel said material from the outlet end after formation;

a plurality of sets of abutting passage-forming members mounted for endwise movement through the container, each set being circumferentially complete and the plurality of sets forming the complete inner surface of the container so that said material within the container is completely surrounded within the passage so formed, the members of each set engaging with each other so that by relative movement the members change the section of the passage enclosed therein while maintaining circumferential completeness;

means for urging a first set of members disposed at said inlet end of said container against said material, so as to compact and diminish said material in cross-section;

reciprocable drive means for imparting endwise driven movement through the container to at least some of said movable members, and through some of the moveable members to the remainder of said members and to said material through contact between said members and said material wherein continuous motion is maintainable, and, means to re-cycle said members back to the inlet end of said container from the outlet end.

2. Apparatus according to claim 1, in which the container is adapted at the outlet end to support a die through which material may be extruded.

3. Apparatus according to claim 1 including heating means through which the passage-forming members may pass during re-cycling.

4. Apparatus according to claim 1 in which the container also includes a stationary hollow outer support structure against which movable passage-forming members slide.

5. Apparatus according to claim 1 in which the container includes a plurality of reciprocable rams adapted to bear upon the passage-forming members in directions angled towards the container axis and in which movement of members through the container will cause them to pass into and out of contact with successive rams as movement proceeds.

6. Apparatus according to claim 1 in which at least the greater part of the forming force is exerted by the drive means upon the movable passage-forming members, and is transmitted by them to the material.

7. Apparatus according to claim 1, comprising a plurality of sets of passage-forming members, successive sets being disposed along the length of the container so that the inner surface of the container comprises a stack of at least two sets of members.

8. Apparatus according to claim 7 in which the reciprocable drive means comprise rams or like means bearing upon passage-forming members at the inlet end of the container, and their force is transmitted to succeeding sets of members by set-to-set contact.

9. Apparatus according to claim 1 in which there is interlocking engagement between members of any one set, whereby some of these interlocked members are capable of transmitting axial thrust upon the others, and in which the drive means exert the driving force only upon those members that are capable of transmitting thrust in this way.

10. Apparatus according to claim 9, in which successive sets of members, within the stack are so arranged that those members that are to receive thrust when close to the inlet end of the container occupy different positions around the material from those in the preceding or succeeding set, whereby said reciprocable drive means does not have to be disconnected, thus halting the drive to the material, while the succeeding set of members is put into place after recycling.

11. Apparatus according to claim 1 including means to bring a recycled set of passage-forming members into contact with material upstream of the container, and there to effect some preliminary formation of that material and preliminary alignment of the passage-forming members before they become part of the inner surface of the container.

12. Apparatus according to claim 1 in which the cross-section of the passage formed by the passage-forming members is substantially constant throughout the container.

13. Apparatus according to claim 1 in which the cross-section of the passage formed by the passage-forming members is gently divergent throughout the container, so that at least some of the passage-forming members are constrained to move, and with them the outer surface of the material which they encase, along diverging paths.

14. Apparatus according to claim 13 in which the divergence applies to only one axis of the cross-section of the passage.

15. Apparatus according to claim 13 in which the divergence applies to both axes of the cross-section of the passage.

16. Apparatus according to claim 1 in which the faces of the passage-forming members adapted to bear against the material have a rough finish, to enhance the coefficient of friction between the members and the material.

17. Apparatus according to claim 1, wherein said means for urging a first set of members against said material includes means for reciprocably urging said first set of members against said material.

18. Apparatus according to claim 1, wherein said members include interlocking flange members and recess members.

19. Apparatus according to claim 1, which further comprises means for applying tangential forces, with respect to said material, to said members for providing a level of pressure between adjacent members of said first set of members.

20. A method of extruding a solid billet comprising the steps of:

feeding said billet into the open end of a container;

enclosing said billet inside said container within a passage formed by a plurality of sets of passage-forming members movable endwise through said container, each of said sets completely circumferentially surrounding the section of said billet;

interengaging said members of each of said sets of passage-forming members;

reciprocably driving at least some of said members so as to impart drive to the remainder of said members, such that all of said members move through said container with said billet wherein continuous motion is maintainable;

contacting said billet with at least one set of members whereby at least a substantial part of the extrusion force is thus imparted to said billet;

extruding said billet through a die held at the outlet end of said container; and, re-cycling said members set-by-set back to the inlet end of the container when said members reach the outlet end of said container.

21. A method of forming solid products from powder, comprising the steps of:

disposing said powder within an elongated hollow container, including an inlet and outlet end, the inner surface of which is faced with a plurality of passage-forming members each of which is movable endwise through said container;

interengaging said members with one another;

reciprocably driving said passage-forming members in endwise movement through said container so as to impart a force to said powder that both drives and compacts said powder wherein continuous motion is maintainable;

expelling said powder as a solidified product from the outlet end of said container; and, removing said passage-forming members from said product at the outlet end of said container and re-cycling said passage-forming members to the inlet end of said container.

22. A method of forming solid products according to claim 21, including the step of:

interlockingly engaging said members with one another; and, disposing the axis of said container in a vertical direction prior to said step of disposing said powder within said container.

23. A method of forming solid products according to claim 21, including the additional step of:

interlockingly engaging said members with one another; and, compacting said powder to effect initial compacting of said powder disposed within said container.

* * * * *